United States Patent [19]

Budecker

[11] 4,445,825

[45] May 1, 1984

[54] RADIAL PISTON MACHINE

[75] Inventor: Ludwig Budecker, Frankfurt am Main, Fed. Rep. of Germany

[73] Assignee: ITT Industries, Inc., New York, N.Y.

[21] Appl. No.: 355,296

[22] Filed: Mar. 8, 1982

[30] Foreign Application Priority Data

May 29, 1981 [DE] Fed. Rep. of Germany ..... 3121529

[51] Int. Cl.[3] ..... F01B 13/06; F04B 15/00

[52] U.S. Cl. ..... 417/462; 91/498

[58] Field of Search ..... 91/180, 491, 492, 498; 417/460, 462; 418/181

[56] References Cited

U.S. PATENT DOCUMENTS

| | | | |
|---|---|---|---|
| 1,936,614 | 11/1933 | Ballman | 417/462 |
| 2,079,119 | 5/1937 | Hillis | 417/462 |

FOREIGN PATENT DOCUMENTS

| | | | |
|---|---|---|---|
| 3001381 | 7/1981 | Fed. Rep. of Germany | 91/491 |
| 956013 | 1/1950 | France | 91/480 |
| 53-47807 | 7/1978 | Japan | 417/462 |
| 1010642 | 11/1965 | United Kingdom | 417/462 |
| 1437743 | 7/1974 | United Kingdom | 417/462 |
| 48006 | 6/1980 | U.S.S.R. | 418/181 |

*Primary Examiner*—William L. Freeh

*Attorney, Agent, or Firm*—James B. Raden; Marvin M. Chaban

[57] ABSTRACT

The radial piston machine comprises a rotor-stator unit including an outer stator and an inner rotor received in a housing, with the rotor being rotatable with a connected shaft through a spring clutch engaging one rotor end face. The rotor is centered axially elastically relative to the stator. The stator includes on its periphery at least one elastic body supporting the unit in the housing in a radially elastic and substantially torsionally secured and axially located fashion. At least another sealing body provided on the periphery of the stator seals the unit relative to the housing in the area of a pressure port, such that the elastic body associated with the sealing body is not acted upon by hydraulic pressure. Because the sealing and supporting functions are accomplished by separate constructional elements in the form of elastic bodies and sealing bodies, hydraulic pressure does not act on the elastic bodies when the machine is in operation, so that their elasticity cannot be impaired by the hydraulic pressure.

20 Claims, 2 Drawing Figures

RADIAL PISTON MACHINE

BACKGROUND OF THE INVENTION

The present invention relates to a radial piston machine and, in particular, a radial piston pump comprising a sealed rotor-stator unit received in a housing in an axially located, radially elastic and torsionally secured fashion, the rotor thereof being rotatable with a connected shaft situated in a coaxial extension of the rotor through a spring clutch engaging one rotor end face.

In hydraulic machinery, especially in pumps, noise produced by vibrations of single members is a frequent occurrence. The pressure pulsation in the pressure port is an important factor in the production of such vibrations.

In order to avoid such vibrations, with the aim to reduce the noise occurring in operation, a radial piston machine of the type referred to hereinabove is known from German Patent DE-AS No. 2,334,138. The rotor-stator unit possesses a central control pintle with radial grooves in which O-rings are disposed under prestress to thus hold the control pintle in the housing elastically. The control pintle and mounting hole are so dimensioned that no metallic contact occurs, the O-rings are the only connecting elements between the control pintle and the mounting hole. Because the pressure port of the machine is arranged between the O-rings, the O-rings assume not only a retaining, but also a sealing function with the pump in operation.

A disadvantage in this known arrangement is that with increasing compressive load on the O-rings, the elasticity is impaired, resulting in increased noise.

SUMMARY OF THE INVENTION

It is an object of the present invention to provide a radial piston machine of simple construction which is manifested by the feature that it develops little noise during operation, even when subjected to major pressure.

A feature of the present invention is the provision of a radial piston machine comprising a sealed rotor-stator unit received in a housing in an axially located, radially elastic and torsionally secured fashion, the unit having a rotor disposed within a stator, the rotor being rotatable in the stator by a connecting shaft through a spring clutch engaging one end face of the rotor; an elastic means disposed on the periphery of the stator to support the unit in the housing in the axially located, radially elastic and torsionally secured fashion; and a sealing means disposed on the periphery of the stator adjacent the elastic means to seal the unit to the housing.

In particular, the other end face of the rotor which is axially slidably received in the stator is axially elastically supported at the stator by a ball-and-spring arrangement.

The ball-and-spring arrangement comprises a cup-type bushing secured to the stator receiving a compression spring, wherein the end of the compression spring on the side close to the spring clutch of the connected shaft rotatably supports a bearing ball which is in engagement with the adjacent other end face of the rotor.

In an advantageous improvement of this invention, the bearing ball engages in a frontal recess in the rotor alongside a line contact.

The elastic bodies are suitably two axially spaced O-rings with associated sealing rings being interposed as further bodies. The sealing rings are suitably provided with a sealing lip.

Each sealing ring bears in an axial direction against a back ring having internal circumferential clearance relative to the stator, with the back ring being arranged between the sealing ring and the associated O-ring.

An optimum noise-damping effect is accomplished by inserting a porous member into the pressure channel of the stator.

Particularly, the pressure channel of the stator is adapted to be connected to an inclined bore of a rotor possessing only one spherical piston. The radial piston machine is thus constructed as a spherical piston pump with few construction elements which, while creating greater pressure pulsations, damps them optimally.

To further locate the rotor-stator unit in an axially and torsionally elastic manner, another elastic element can be arranged at the bottom of the housing.

The advantages achieved with the present invention are in particular that this invention provides separate construction means for sealing and supporting the rotor-stator unit. With the machine in operation, the sealing bodies and the elastic bodies assume exclusively a sealing function and an elastic retaining function, respectively. In this arrangement, the sealing bodies are situated between the pressure port and the elastic bodies, such that hydraulic pressure does not act on the elastic bodies which thus retain their original elasticity in operation. The ball-and-spring arrangment between rotor and stator creates an additional resilient counter-support of the rotor prestressed by the spring clutch in an axial direction, with only little friction losses occurring between rotor and stator.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENTS

Figure 1:
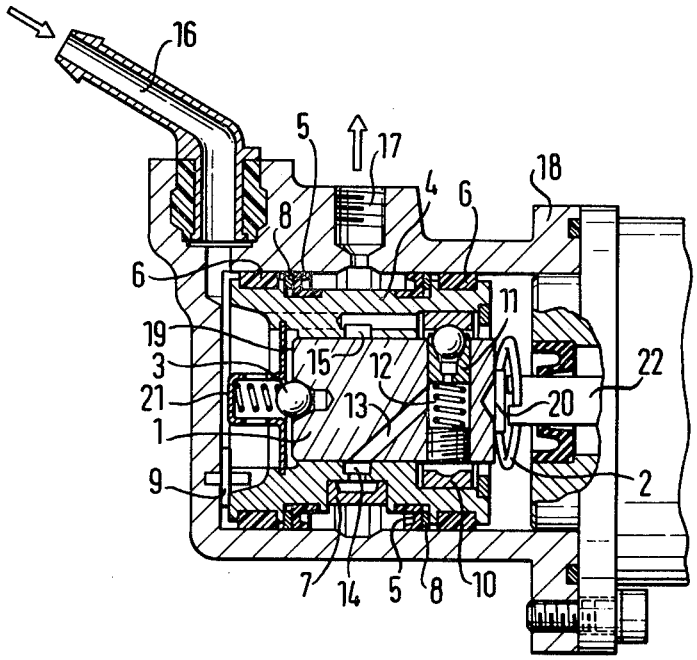
FIG. 1 is a longitudinal cross sectional view of a first embodiment of a radial piston pump in accordance with the principles of the present invention.

Referring to FIG. 1, the radial piston pump comprises a cup-type housing 18, closed at the end face, accommodating a rotor-stator unit including an outer stator 4 and an inner rotor 1. The rotor 1 is axially slidable relative to the surrounding stator 4 by a slight amount and is held centered in an axially elastic position by a torsionally and axially elastic spring clutch 2 interposed between one end face 20 of rotor 1 and a connected shaft 22 situated in a coaxial extension of rotor 1, and by a ball-and-spring arrangement 3 interposed between the other end face 19 of rotor 1 and stator 4. The connected shaft 22 is part of an electric motor (not shown) driving the radial piston pump.

The ball-and-spring arrangement 3 comprises a cup-type bushing 21 secured to stator 4 and receiving a compression spring, wherein the end of the spring closest to spring clutch 2 of the connected shaft 22 rotatably supports a bearing ball which is in engagement with the adjacent other end face 19 of rotor 1. The bearing ball engages in a frontal recess in rotor 1 alongside a circumferential line. The axial support of rotor 1 on the bearing ball with a weakly dimensioned compression spring produces—caused by the small contact diameter of the ball—only a relatively low loss moment.

Stator 4 includes two peripheral grooves in which elastic O-rings 6 are arranged under prestress, thereby elastically supporting stator 4 in housing 18 in such a manner that a slight torsional, axial and radial elasticity is provided in operation of the arrangement.

In a similar manner, stator 4 includes two further peripheral grooves each receiving a sealing ring 5 having a lip seal adjacent housing 18 and bearing against an associated back ring 8. Back rings 8 have an internal circumferential clearance relative to stator 4 so that radial forces are hardly transmitted. Each sealing ring 5 with its associated back ring 8, is assigned an O-ring 6 in such a way that in operation hydraulic pressure does not act on O-rings 6 which thus retain their original elasticity, irrespective of the magnitude of the generated pump pressure.

To support a torque which is not already transmitted from O-rings 6 to housing 18, another elastic element 9 is arranged at the bottom of housing 18 to provide an additional axially elastic support for the rotor-stator unit. The inner rotor 1 possesses a radial passageway receiving a spherical piston 11 slidably therein, the piston being urged against an outer cam ring 10 of stator 4 by means of a spring. Cam ring 10 is eccentrically disposed relative to rotor 1. The spring of spherical piston 11 bears against a plug which is pressed into the end of the rotor's radial passageway remote from spherical piston 11 and is terminated by the outer periphery of rotor 1.

The plug and spherical piston 11 form a sealed chamber 12 inwardly of rotor 1 with one end of an inclined bore 13 of rotor 1 opening into chamber 12.

The other end of inclined bore 13 is on the outer periphery of rotor 1 and is allocated to both a pressure channel 14 and a suction channel 15 of stator 4, which channels are connected to the pressure port 17 and the suction port 16, respectively.

Inserted into pressure channel 14 is a porous member 7 which damps the pressure pulsations before the hydraulic pressure is delivered to a slave unit through pressure port 17 disposed between sealing rings 5.

The mode of operation of the radial piston pump will now be described.

The pump rotor 1 is driven via an electric motor and the torsionally and axially elastic spring clutch 2. The eccentric position of cam ring 10 causes spherical piston 11 to change the size of chamber 12 as rotor 1 rotates. When rotor 1 is rotated away from the position shown by 180°, a vacuum will be built up in chamber 12 by spherical piston 11, permitting unpressurized hydraulic fluid to be drawn in through suction port 16 when inclined bore 13 is in communication with suction channel 15. In the course of the half rotation of rotor 1 that follows, the sliding movement of spherical piston 11 into rotor 1 will cause the hydraulic fluid in chamber 12 to be discharged via inclined bore 13, radial pressure channel 14 and pressure port 17.

Figure 2:
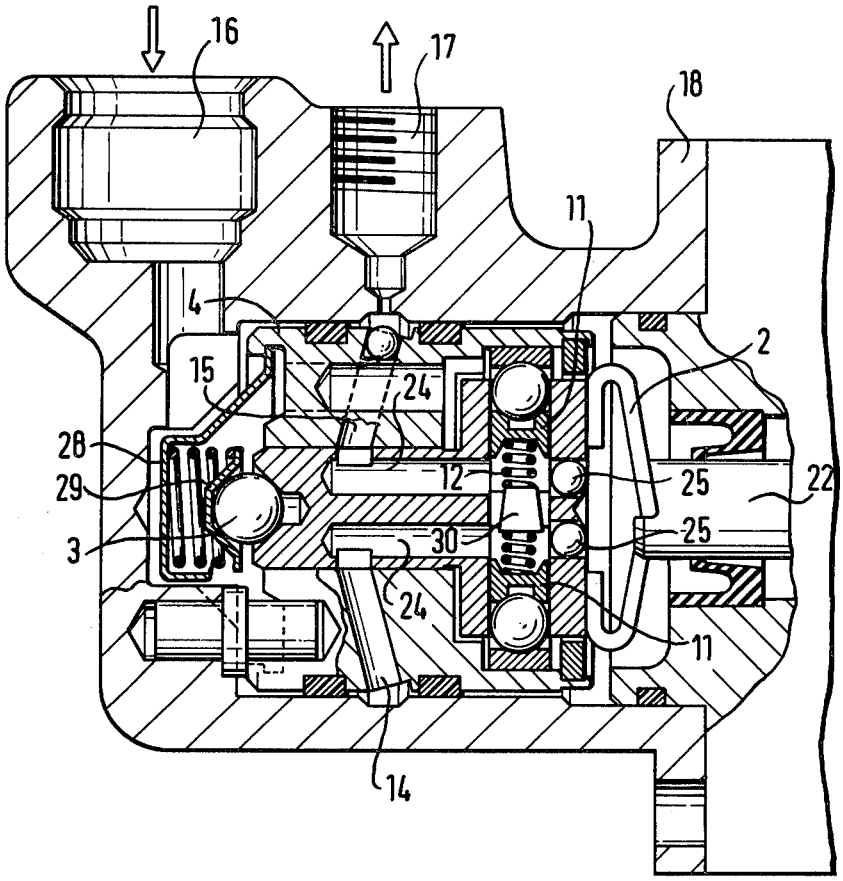
FIG. 2 is a longitudinal cross sectional view of a second embodiment of a radial piston pump in accordance with the principles of the present invention.

The embodiment of the radial piston pump of FIG. 2 includes two spherical pistons 11 each having an inner compression spring bearing against an axially centric sealing plug 30 fixed in rotor 1. Each chamber 12 associated with a different one of the spherical pistons 11 is in communication with an eccentric longitudinal bore 24 internally of rotor 1, the operation of these bores corresponding to that of inclined bore 13 of the first embodiment. The longitudinal bores 24 which are integrated into rotor 1 as blind-end bores are sealed off by ball closure members 25 on the side close to spring clutch 2.

Further, the embodiment of FIG. 2 comprises a ball-and-spring arrangement 3 wherein the ball is received in a socket-type countersupport 29 which in turn bears against one end of the spring of the arrangement. The other end of the spring bears against the bottom of a cup support 28 having a clamp-type peripheral flange engaged in a secure manner in the end of stator 4 opposite spring clutch 2. In this manner, the axial friction losses of rotor 1 are still further reduced. The ball-and-spring arrangement 3 is so constructed as to enable the arrangement to be mounted and dismounted readily.

The operation of the radial piston pump of FIG. 2 corresponds to that of FIG. 1. It will be apparent that, compared with the first embodiment, two spherical pistons permit a higher delivery pressure to be accomplished at reduced pressure pulsations.

While I have described above the principles of my invention in connection with specific apparatus, it is to be clearly understood that this description is made only by way of example and not as a limitation to the scope of my invention as set forth in the object thereof and in the accompanying claims.

I claim:

1. A radial piston machine comprising;

a sealed rotor-stator unit received in a housing in an axially located, radially elastic torsionally secured fashion, said unit having a rotor disposed within a stator and having at least one valued chamber located within said rotor and formed by piston means, said rotor being rotatable in said stator by a connecting shaft through a spring clutch engaging one end face of said rotor;

an elastic means disposed on the periphery of said stator to support said unit in said housing in said axially located, radially elastic and torsionally secured fashion;

a sealing means disposed on the periphery of said stator adjacent said elastic means to seal said unit to said housing, a ball-and-spring arrangement engaging the other end face of said rotor to axially elastically support said rotor in an axially slidable relationship with said stator wherein said ball-and-spring arrangement includes a cup-type bushing secured to said stator adjacent said other end face of said rotor, a compression spring received in said bushing having one end thereof bearing against the bottom of said bushing, and a bearing ball rotatably supported in the other end of said compression spring and in engagement with said other end face of said rotor.

2. A machine according to claim 1 wherein an elastic element disposed between an end of said stator remote from said clutch and an adjacent end of said housing to additionally support said unit in an axially and torsionally elastic manner.

3. A machine according to claim 1 wherein said stator includes a pressure channel, and said rotor includes two spherical pistons disposed in a radial bore of said rotor, each of said pistons acting on an associated chamber in said radial bore, said rotor having two bores therein each connecting a different one of said two chamber to said pressure channel.

4. A machine according to claim 1 wherein
said stator includes a pressure channel, and
said rotor includes a single spherical piston disposed in a radial bore of said rotor and acting on a chamber therein, said rotor having an inclined bore connecting said pressure channel and said chamber.

5. A machine according to claim 4, further including
a porous member disposed in said pressure channel.

6. A machine according to claim 4, further including
an elastic element disposed between an end of said stator remote from said clutch and an adjacent end of said housing to additionally support said unit in an axially and torsionally elastic manner.

7. A machine according to claim 1, wherein
said bearing ball engages a recess in said other end face of said rotor.

8. A machine according to claim 1 wherein there is
a socket-type support bearing against the other end of said compression spring.

9. A machine according to claim 1 wherein
said elastic means includes
two axially spaced O-rings, and said sealing means includes
a sealing ring associated with each of said O-rings disposed between said O-rings.

10. A machine according to claim 9, further including
a backing ring disposed between each of said sealing ring and an associated one of said O-rings, said sealing rings bearing against an associated one of said backing rings, each of said backing rings having an internal circumferential clearance relative to the periphery of said stator.

11. A machine according to claim 9, wherein
said stator includes a pressure channel, and
said rotor includes two spherical pistons disposed in a radial bore of said rotor, each of said pistons acting on an associated chamber in said radial bore, said rotor having two bores therein each connecting a different one of said two chambers to said pressure channel.

12. A machine according to claim 10, wherein
said stator includes a pressure channel, and
said rotor includes two spherical pistons disposed in a radial bore of said rotor, each of said pistons acting on an associated chamber in said radial bore, said rotor having two bores therein each connecting a different one of said two chambers to said pressure channel.

13. A machine according to claim 9, wherein
said stator includes a pressure channel, and
said rotor includes a single spherical piston disposed in a radial bore of said rotor and acting on a chamber therein, said rotor having an inclined bore connecting said pressure channel and said chamber.

14. A machine according to claim 13, further including
a porous member disposed in said pressure channel.

15. A machine according to claim 13, further including
an elastic element disposed between an end of said stator remote from said clutch and an adjacent end of said housing to additionally support said unit in an axially and torsionally elastic manner.

16. A machine according to claim 10, wherein
said stator includes a pressure channel, and
said rotor includes a single spherical piston disposed in a radial bore of said rotor and acting on a chamber therein, said rotor having an inclined bore connecting said pressure channel and said chamber.

17. A machine according to claim 16, further including
a porous member disposed in said pressure channel.

18. A machine according to claim 16, further including
an elastic element disposed between an end of said stator remote from said clutch and an adjacent end of said housing to additionally support said unit in an axially and torsionally elastic manner.

19. A radial piston pump comprising: at least one valued working chamber located within a rotor and formed by piston means,
a sealed rotor-stator unit fitted within a housing, said unit having said rotor disposed within said stator, said rotor being rotatable in said stator by a connecting shaft extending into said housing through a spring clutch interposed between and engaging one end face of said rotor and said connecting shaft whereby said rotor is centered in an axially and torsionally movable position by said clutch;
axially spaced annular elastic means disposed on the periphery of said stator to support said unit in said housing in an axially located, radially elastic and torsionally secured fashion;
axially separated annular sealing means disposed on the periphery of said stator adjacent the respective elastic means to seal said unit to said housing, said sealing and elastic support means forming the only mounting connection between the stator and housing.

20. A radial piston pump as claimed in claim 19 in which there is a pressure port outlet from said pump, said outlet positioned between the axially separated annular sealing means with one of said elastic supporting means adjacent to respective sealing means on the side outboard of said pressure port outlet.

* * * * *